US008272450B2

(12) United States Patent
Van Beurden et al.

(10) Patent No.: US 8,272,450 B2
(45) Date of Patent: Sep. 25, 2012

(54) FIRE BLANKET AND METHOD FOR USING OR TESTING A FIRE BLANKET

(75) Inventors: Karin Monique Maria Van Beurden, Enschede (NL); Iris Epkjen Hobo-Van Der Graaf, Deventer (NL)

(73) Assignee: Karin Monique Maria Van Beurden, Enschede (NL)

( * ) Notice: Subject to any disclaimer, the term of this patent is extended or adjusted under 35 U.S.C. 154(b) by 258 days.

(21) Appl. No.: 12/667,152

(22) PCT Filed: Jun. 27, 2008

(86) PCT No.: PCT/NL2008/050427

§ 371 (c)(1), (2), (4) Date: Feb. 9, 2010

(87) PCT Pub. No.: WO2009/005347

PCT Pub. Date: Jan. 8, 2009

(65) Prior Publication Data

US 2010/0200250 A1 Aug. 12, 2010

(30) Foreign Application Priority Data

Jun. 29, 2007 (NL) ..... 1034064

(51) Int. Cl.

| | |
|---|---|
| ***A62C 8/06*** | (2006.01) |
| ***A62C 8/08*** | (2006.01) |
| ***A62C 2/06*** | (2006.01) |

(52) U.S. Cl. ..... 169/50; 169/46

(58) Field of Classification Search ..... 169/45, 169/46, 48–50, 54, 65; 428/920, 921; 431/144
See application file for complete search history.

(56) References Cited

U.S. PATENT DOCUMENTS

| | | | | |
|---|---|---|---|---|
| 3,828,856 | A | 8/1974 | Wallis | |
| 3,942,669 | A * | 3/1976 | Savage, Jr. | 220/481 |
| 4,269,901 | A * | 5/1981 | Chamberlain | 428/542.8 |
| 4,597,450 | A | 7/1986 | Budmiger | |
| 4,650,002 | A * | 3/1987 | Pierce, Jr. | 169/50 |
| 4,956,218 | A * | 9/1990 | Haining | 428/102 |
| 5,083,617 | A * | 1/1992 | Pierce, Jr. | 169/50 |
| 5,518,074 | A * | 5/1996 | Brotherson | 169/50 |
| 2005/0051345 | A1 * | 3/2005 | Calderwood et al. | 169/49 |

FOREIGN PATENT DOCUMENTS

| | | |
|---|---|---|
| DE | 20 2005019170 U1 | 4/2006 |
| GB | 1 464 622 | 2/1977 |
| GB | 2 103 084 A | 2/1983 |
| GB | 2 298 574 A | 9/1996 |
| GB | 2 322 549 A | 9/1998 |

OTHER PUBLICATIONS

International Search Report dated Dec. 1, 2008, for PCT/NL2008/050427.

* cited by examiner

*Primary Examiner* — Darren W Gorman
(74) *Attorney, Agent, or Firm* — Leydig, Voit & Mayer, Ltd.

(57) ABSTRACT

A fire blanket, comprising poorly flammable or inflammable, substantially flexible blanket material, wherein the blanket material is folded into a storage position, wherein the blanket material is provided with two relatively rigid handles, which handles project at least partly outside the folded fire blanket, so that they can be grasped by at least one hand, and wherein the blanket material is folded up such that when the handles are moved apart, the fire blanket takes up an extinguishing position.

20 Claims, 13 Drawing Sheets

FIRE BLANKET AND METHOD FOR USING OR TESTING A FIRE BLANKET

FIELD OF THE INVENTION

The invention relates to a fire blanket, comprising poorly flammable or inflammable, flexible material and surrounded at least largely by a package.

The invention also relates to a method for testing or using a fire blanket.

BACKGROUND

Fire blankets are designed to be draped over fire so that less oxygen can reach the fire and it is smothered. Fire blankets are in particular suitable for extinguishing relatively small fires. Fire blankets are in particular suitable for a fire in a pan and/or with liquid fires. In restaurant kitchens, for instance, fire blankets can be provided for prevention.

As a rule, fire blankets are manufactured from fire-resistant, i.e. poorly flammable or inflammable, material, which is flexible. A known material for that purpose is, for instance, woven glass fiber, with or without a fire-resistant coating, but several suitable materials are known.

In case of fire, the fire blankets are to be used rapidly in order to prevent a fire from causing more damage. The fire blanket should then be used in a safe manner so that fire does not injure the user. Furthermore, the fire blanket must also actually extinguish the fire. In order to manage all this properly, the packages of the fire blankets are often provided with directions for use.

Still, in practice it appears that a user cannot utilize the fire blanket rapidly, safely and effectively at the same time. Thereto, often, training, experience or courses given by for instance the fire department are required.

With known fire blankets, at least according to the instructions from the fire department, the user must wrap his hands in the fire blanket and at the right position so that the blanket protects his hands and body while be drapes the blanket over the respective fire. Such an operation generally requires time and practice.

SUMMARY OF THE INVENTION

The object of the invention therefore is to provide a solution which enables also a user who has not been informed in advance to use a fire blanket better in a relatively rapid, safe and/or effective manner.

This object and/or other objects are achieved with a fire blanket according to the invention, comprising poorly flammable or inflammable, substantially flexible material, wherein the fire blanket is folded into a storage position, wherein the fire blanket is provided with two relatively rigid handles, which handles project at least partly outside the folded-up fire blanket, so that they can be grasped by at least one hand, and wherein the fire blanket is folded such that when moving the handles apart, the fire blanket takes up an extinguishing position.

For a better understanding of the invention, a few terms which are used will be elucidated. In a storage position, the fire blanket is folded up and preferably surrounded by a package. In the storage position, the fire blanket takes up little surface and it can be suspended better, put on a shelf or be stored differently. In an extinguishing position, the fire blanket is at least somewhat folded-out so that it can be draped over the fire.

In this specification, "folded" or "folded-up" blanket is understood to mean that the blanket can be crumpled up, folded-in, wound, folded-over at least once, etc. Here, in principle, a storage position can be involved which blankets or sheets take up in order to occupy less surface. Preferably, but not necessarily, two handles project outside the fire blanket and in a storage position, they can be grasped by two hands. However, it is also possible that initially, two handles are to be grasped by one hand. The fire blanket according to the invention is suitable to be directly folded open from a storage position into an extinguishing position, without thereto prior knowledge being required. This saves a considerable amount of time, which can be essential when extinguishing fires. Thus, the fire blanket according to the invention is provided with features which prevent a storage position from hindering direct use of this fire blanket.

To this end, the handles of the blanket project outside the folded-up fire blanket so that they can be grasped intuitively, while it is not necessary that the blanket is unfolded or that first, a package is to be removed.

When pulling the handles apart, the fire blanket will preferably unfold by itself into an extinguishing position, so that prior knowledge is not required. When compared to the conventional fire blankets, use of a fire blanket according to the invention saves the time of, inter alia, unwrapping the fire blanket, carefully unfolding and looking for a position for the hands. As the fire blanket takes up an extinguishing position immediately after unfolding, it can be utilized in an ergonomic manner, rapidly, effectively and intuitively. In one embodiment, the fire blanket is surrounded at least partly by a package. This package can protect the fire blanket for an extended period of time so that this, for does not become, for instance, wet or greasy. Advantageously, directions for use can be provided on the package. Furthermore, the package can be provided with, for instance, a red colour, which colour is often associated with fire, emergencies and/or the fire department. Here, the handles project at least partly outside the package and when the handles are moved sufficiently, the fire blanket will be removed from the package. With this, no time will be wasted with unwrapping the fire blanket and the package will be removed by itself from the fire blanket while this takes up an extinguishing position.

Preferably, the fire blanket can be taken from the package several times, so that practicing with the fire blanket can take place several times, and the fire blanket can thereupon be included in the package again.

Preferably, the handles are positioned on the blanket such that, when it is grasped, the fire blanket protects the user in a relatively safe manner. The handles can be fastened, for instance, adjacent the top corners of the fire blanket, yet at a sufficient distance from the edges, so that the blanket screens the user from the fire while the fire blanket can be handled well.

In particular, one or several embodiments of the invention can meet the Dutch standard for fire blankets NEN-EN 1869, or, for instance, an equivalent thereof that is in effect in one or more other countries.

The invention is also characterized by a method for testing or using a fire blanket, preferably a fire blanket according to the invention, wherein the fire blanket comprises fire blanket material and two handles, wherein, with the fire blanket material folded into a storage position, the handles are grasped and are sufficiently moved apart so that the fire blanket is pulled open into an extinguishing position.

BRIEF DESCRIPTION OF THE DRAWINGS

Further advantages and features of the present invention follow from the following description, wherein the invention is described in further detail in several exemplary embodiments on the basis of the accompanying drawings. In the drawing.

DETAILED DESCRIPTION OF THE DRAWINGS

Figure 1B:
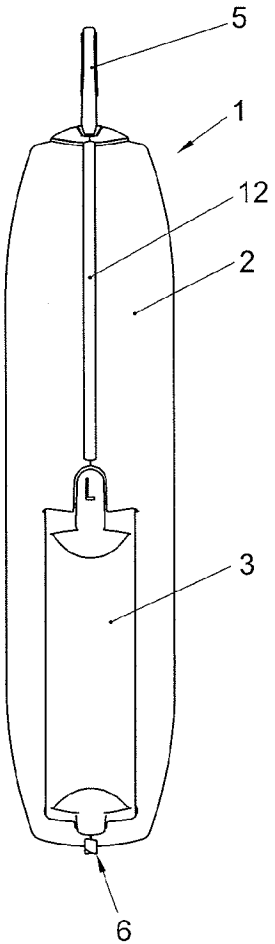
FIGS. 1A and 1B show a fire blanket in front view and side view.

In this description, identical or corresponding parts have identical or corresponding reference numerals. In the drawing, embodiments are shown merely by way of example. The elements used therewith are only mentioned by way of example and should not be construed to be limitative in any manner. Other parts too can be utilized within the framework of the present invention. The proportions of the embodiments shown in the Figures are often represented in a schematic and/or exaggerated manner and should not be understood to be limitative in any manner.

Figure 1A:
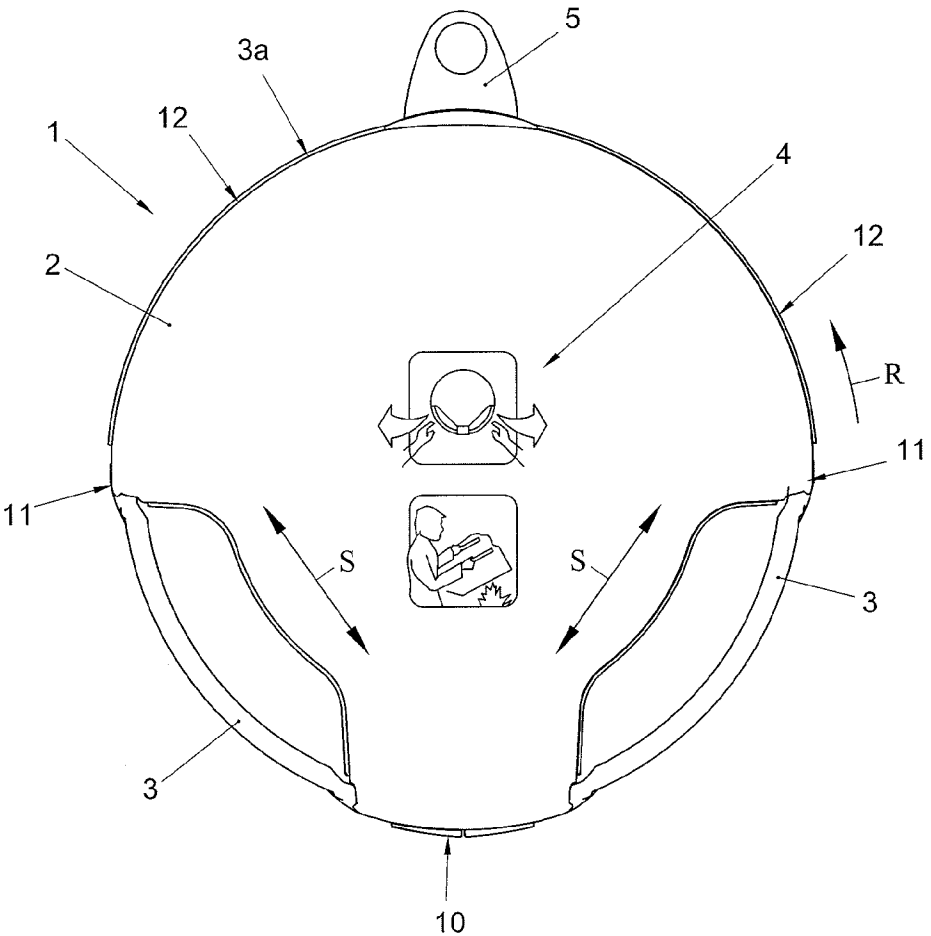

FIGS. 1A and 1B show a fire blanket 1 according to the invention in front view and side view. The fire blanket material 6 of the fire blanket 1 is folded into a storage position and is partly surrounded by a package 2. The package is preferably manufactured from relatively rigid plastic dish parts which enclose the folded fire blanket material and preferably comprises poorly flammable material. Two relatively rigid handles 3 project partly outside the package 2 and extend along the package 2, so that already in the storage position shown they can each be taken in a hand. The handles 3 are manufactured from, for instance, plastic. The fire blanket 1 is folded such that the outer contour of the folded-up blanket material 6 lies within the package 2. Directions for use 4 are provided on and/or in the package 2 for representing the use of the fire blanket 1. The top illustration of the directions for use 4 shows for instance the storage position of the fire blanket 1 and represents how two hands can reach for the handles 3, while arrows indicate that thereupon, the handles 3 can be pulled apart. The illustration therebeneath represents, for instance, the fire blanket 1 in an extinguishing position, wherein the handles 3 are pulled apart and the fire blanket material 6 is held above the fire in order to be draped over it.

Figure 2A:
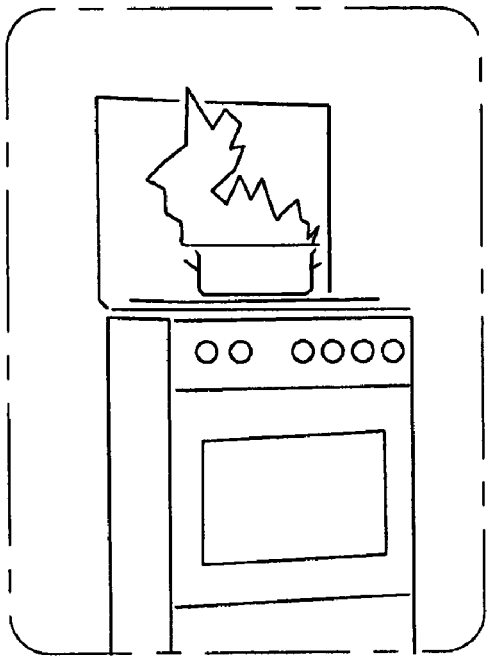
FIGS. 2A-J show a scenario for use of a fire blanket.
Figure 2B:
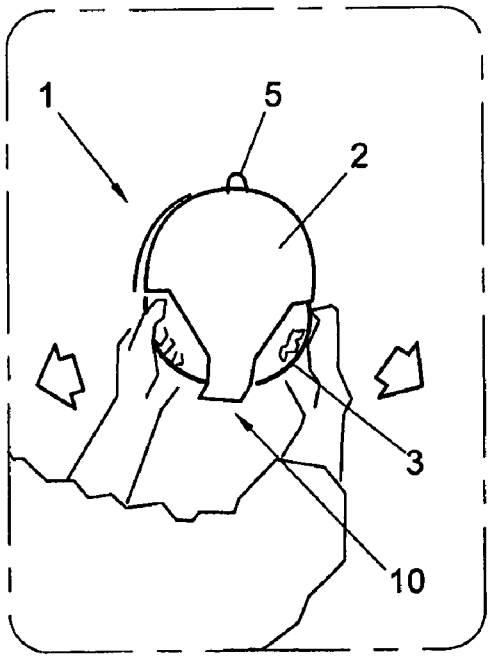
Figure 2C:
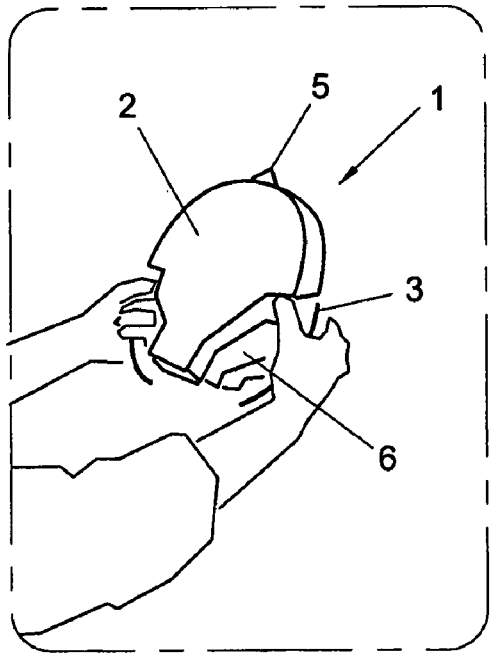
Figure 2D:
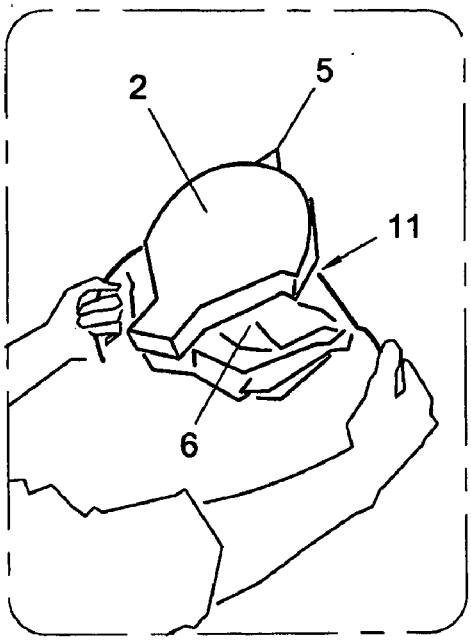

A method for using or testing a fire blanket 1 is shown in steps in FIGS. 2A-2J. In a practical situation, a pan may have caught fire (FIG. 2A). In the proximity of the fire, by means of, for instance, a suspension element 5, a fire blanket may be suspended from, for instance, a nail, screw or other suspension means in the wall (FIG. 2B). The handles 3 are each taken in one hand by the user. Then, the handles 3 are moved apart such that the package 2 comes loose from the fire blanket 1 (FIG. 2C), whereby the fire blanket material 6 is released from the package 2. Advantageously removing the package 2 from the fire blanket can be effected in several manners. In the embodiment shown, by pulling the handles 3 apart and through the elasticity of the packaging material, the package 2 tends to slide from the handles 33. Here, the shape of the distancing element 3A of the handles 3 contributes to the tendency of the package 2 to slide off along the top. Further onwards in the description, this distancing element 3A will be further elucidated. Here, the closing element 3 opens relatively easily so that the package 2 will slide along the top, from the fire blanket 1 (FIG. 2D). It is noted that the suspension means to which the fire blanket is fastened by means of the suspension element 5 can serve as auxiliary means for pulling the fire blanket 1 from the package 2, for instance away from the suspension element 5, but this is not necessarily the case. In non-suspended condition too, the package 2 can easily be removed or be slid from the folded-up fire blanket 1 by moving the handles 3 apart. The fire blanket 1 can for instance lie in a storage position instead of being suspended, for instance on a shelf or in a drawer or the like (FIG. 3), and from this storage position be directly held in an extinguishing position. Preferably, in a storage position, the package 2 and/or the fire blanket 1 is provided with a red colour, so that the package is clearly noticeable and is associated with fire-resistant means.

Figure 2E:
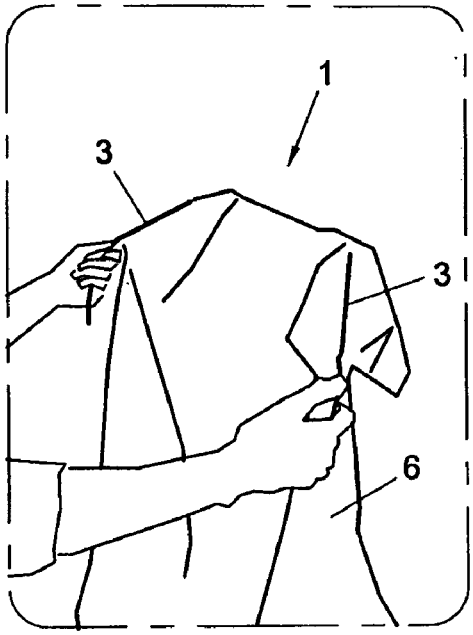
Figure 2F:
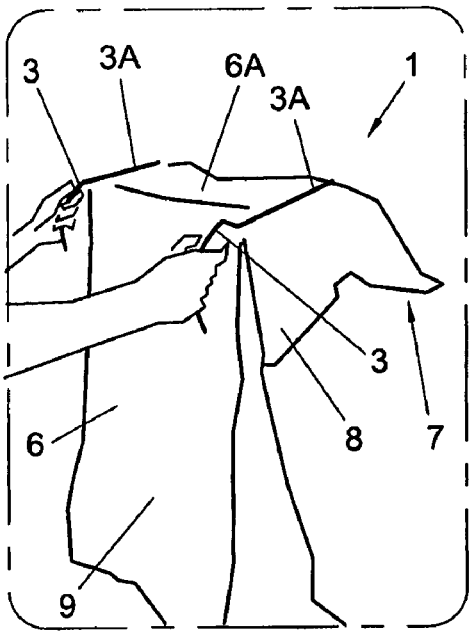
Figure 3:
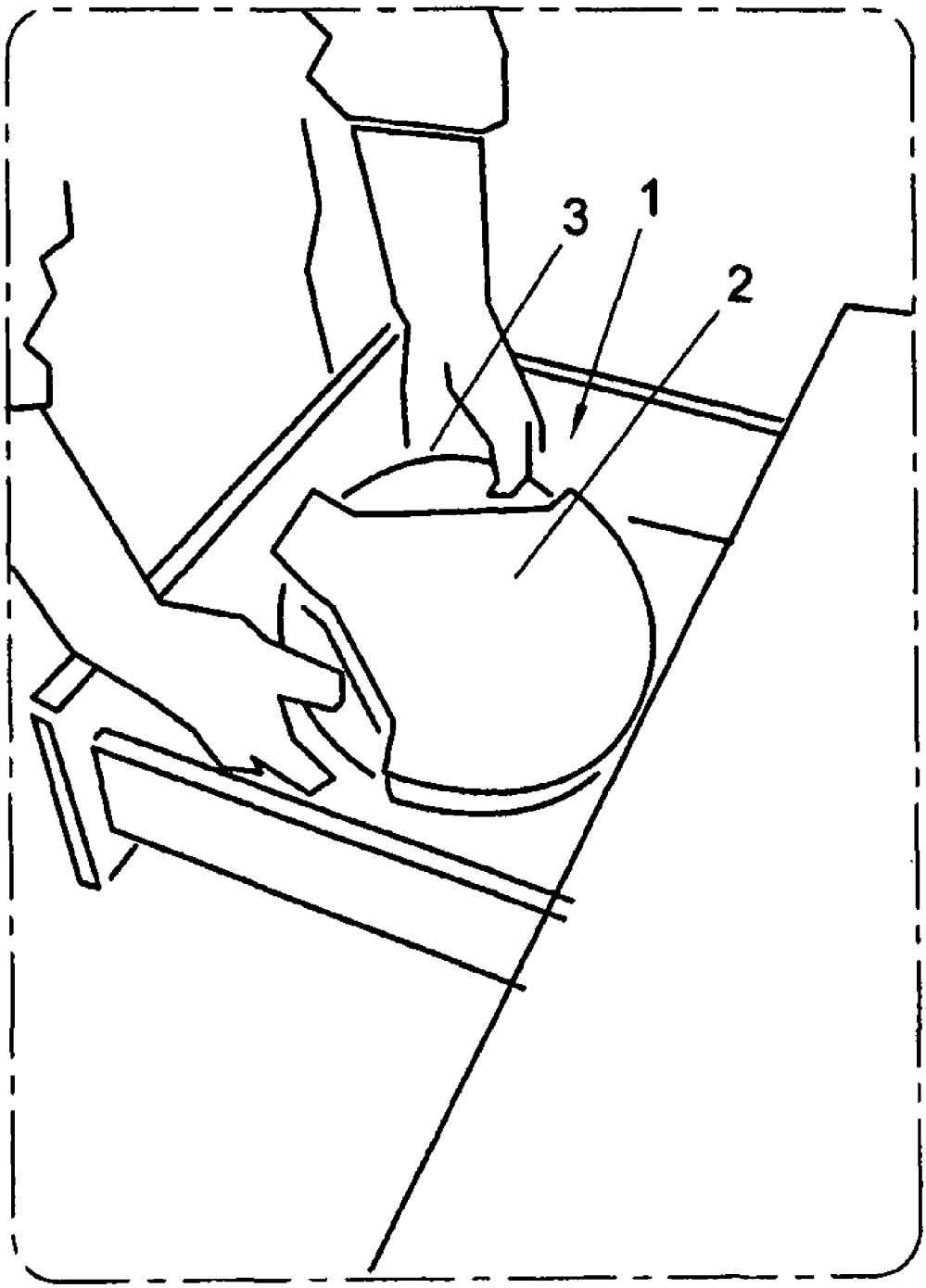
FIG. 3 shows a use of a fire blanket.

Then, by moving the handles 3 further apart, the fire blanket 1 is effortlessly held in an extinguishing position (FIG. 2E). Preferably, the handles 3 have an arcuate shape such that when the user holds his forearms and hands comfortably before him (FIG. 2F), the fire blanket 1 takes up a desired, safe extinguishing position and can be handled well.

Figure 2G:
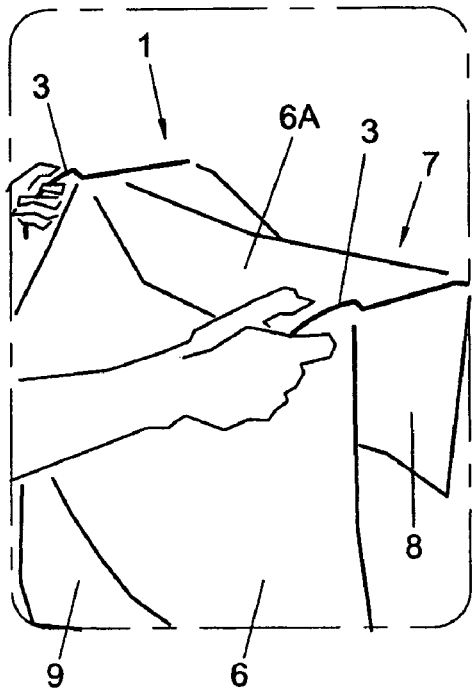
Figure 2H:
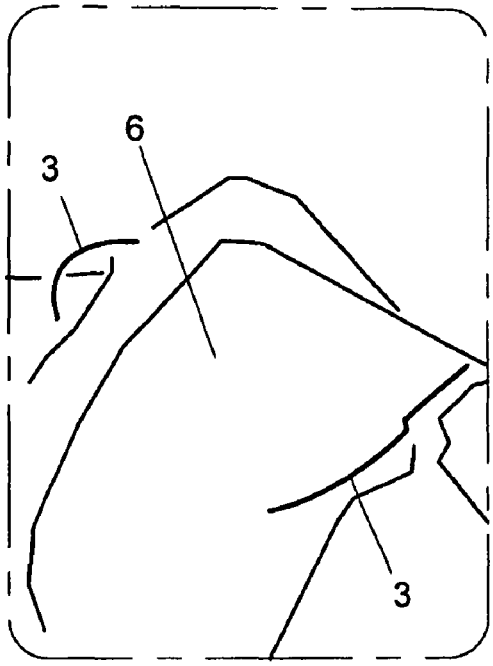

The blanket material 6 has a front flap, side flaps 8 and a relatively large screening flap 9, whereby, owing to the arcuate shape, a part of the handles 3 can be approximately parallel to the screening flap 9, at least in said safe extinguishing position, so that in a comfortable manner, the handles 3 give a comfortable, desired grip. During extinguishing, i.e. smothering, the flaps 7, 8, 9 will surround the fire and/or the pan, while the screening flap 8 and or the side flaps 8 prevent the body of the user from being affected by the fire or the heat (FIG. 2G). The distancing element 3A of the handles 3, which distancing element 3A is fastened to the fire blanket material 6, ensures that the flaps 7, 8, 9 can surround the fire while a blanket part 6A can be held while being stretched to a greater or smaller extent and/or approximately horizontally above the fire. As a result, the fire blanket 1 can be positioned advantageously above the fire. The handles 3 also ensure that some distance to the blanket material 6 and the fire and/or its heat is maintained. The handles 3 are so far removed from each other that the blanket material 6 can be draped on a pan/the fire, while the handles 3 fall/come down beside it (FIG. 2H). Thus, it is ensured in an ergonomic manner that the blanket material 6 completely covers and seals off the pan and, hence, the fire. After covering the stove, the user leaves the blanket 1 and, if applicable, turns off the stove. When the risk of fire has gone and/or the blanket and/or the stove has sufficiently cooled down, at will, the handles 3 can be taken from the blanket material 6 (FIG. 2I) and the used fire blanket 1 can for instance be thrown away.

Although in the embodiments shown in the FIGS. 2A-2J the package 2 slides along the top from the fire blanket 1, the package 2 could for instance also be designed for sliding from the fire blanket 1 along the bottom. The closing element 10 is then for instance provided adjacent the top side of the package 2. In an alternative embodiment, the fire blanket 1 is held in a storage position for instance without package 2.

Figure 2I:
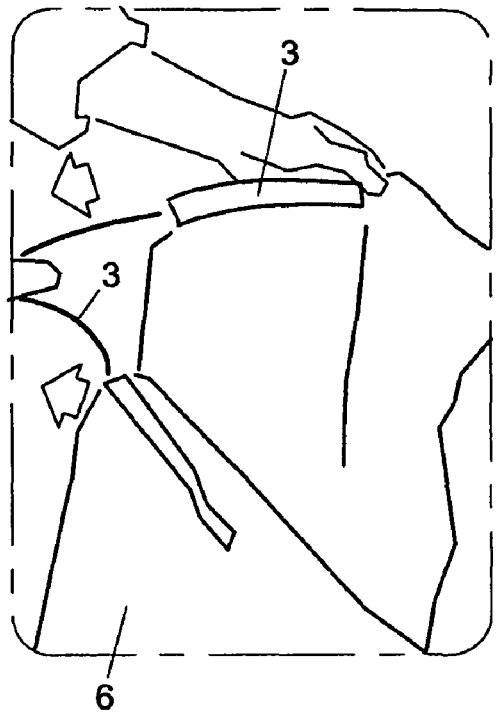
Figure 2J:
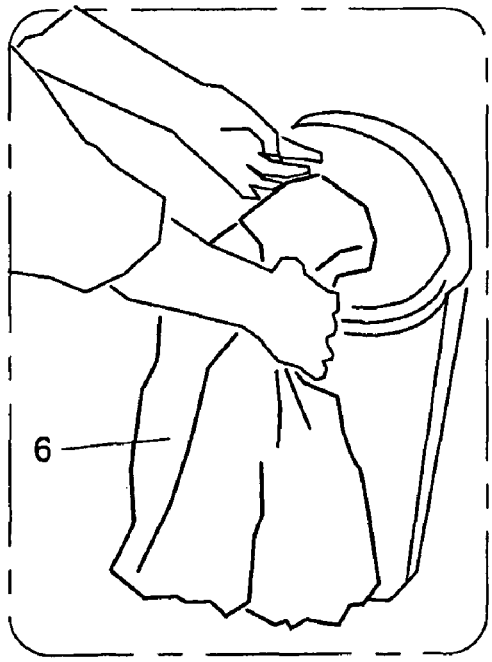

The closing element 10 is preferably designed such that it opens relatively easily when the handles 3 are moved apart. The closing element 10 is for instance designed such that it is pulled open through a stress in the packaging material, for instance in one of the directions S, when the handles 3 are pulled apart (FIG. 1). Along the side edge 12, the package 2 is preferably closed. When pulling the handles 3 open, the points 11 will slide in the direction R along the handles 3 (FIG. 2I). The closing element 10 can comprise, for instance, connecting parts such as parts hooking into each other, Velcro tape, snap fasteners, ribbon or tape parts fastened to each other, a buckle, or otherwise suitable connecting parts, preferably selected such that they come loose relatively easily under stress. It can also be advantageous to arrange the closing element 10 opposite the suspension element 5, at the other side of the fire blanket 1, at least the package 2, for instance for having the package 2 slide from the fire blanket along the bottom.

Preferably, the package 2 is constructed such that it is suitable to be removed intact from the fire blanket and to be reused.

Figure 4:
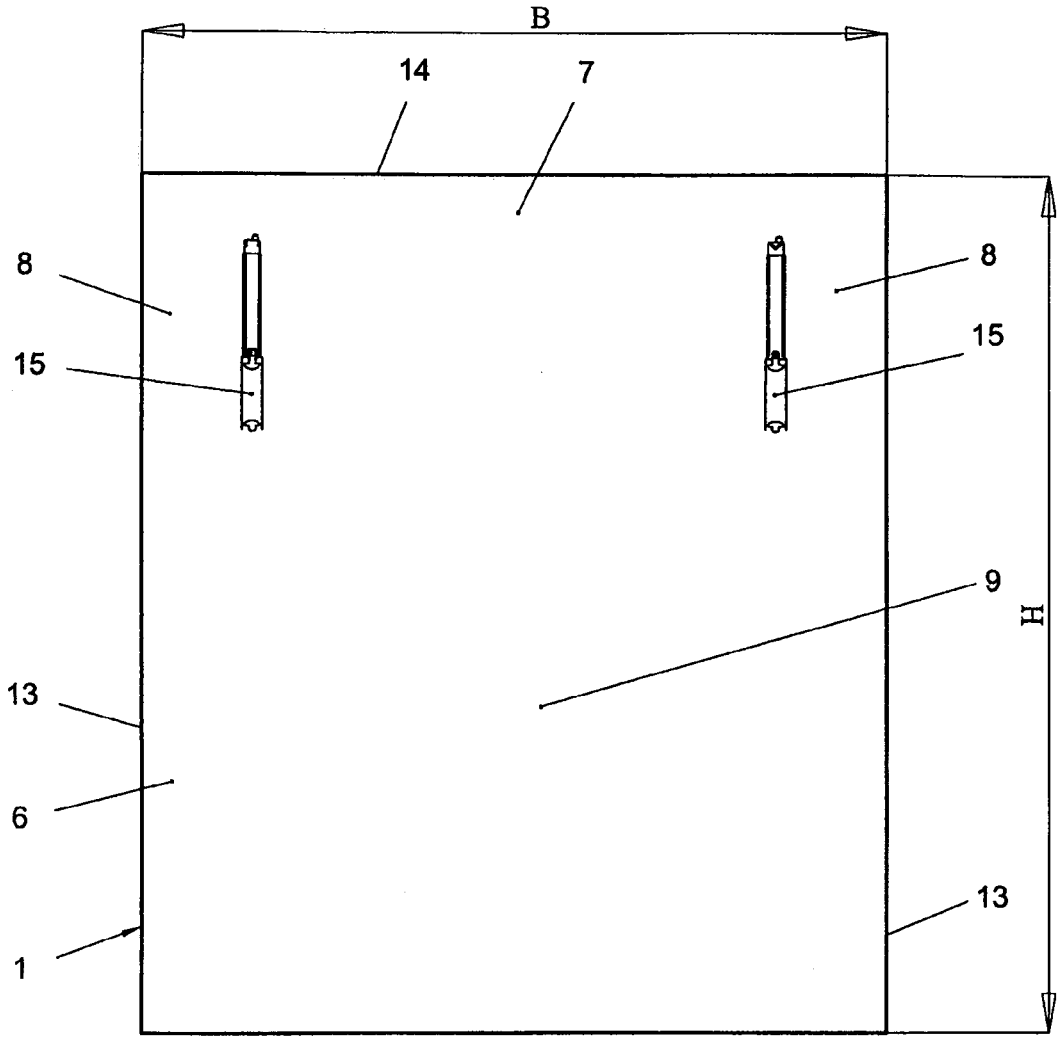
FIG. 4 and FIG. 4A show fire blanket material in folded-out condition.

One embodiment of folded-out fire blanket material 6 without handles 3 is shown in FIG. 4. By way of illustration, a number of measurements are indicated. The fire blanket 1 may have a height H and a width B in the order of 130 and 110 cm respectively, with the width B and/or the height H preferably being at least 90 cm. Other advantageous heights H and/or widths B are for instance in an order of between 90 and 180 cm. The handles 3, or at least the distancing elements 3A are fastened to the blanket material 6 for instance by inserting the distancing elements 3A partly through tunnels 15 into the cloth material 6 and coupling them with the cloth material. The handles 3 may be provided with hooks which engage in the blanket material 6 and which prevent the handles 3 from sliding from the blanket material. In other embodiments, the handles 3 are for instance sewn, clicked, clamped, popped or glued or the like to the blanket material 6. In another advantageous embodiment, the handles 3 are fastened to the blanket material 6 with the aid of small brackets.

Owing to the positioning of the handles 3, with the fire blanket 1 held in extinguishing position (FIG. 2F), a front flap 7, side flaps 8 and a screening flap 9 with favourable sizes will be formed. The surface of the front flap 7 is preferably considerably smaller than the surface of the screening flap 9 as in case of fire, the front flap 7 is lifted over the fire while the screening flap 9 screens the user from the fire.

The handles 3 and/or the tunnels 15 are fastened, at least positioned, to the fire blanket material at a distance of at least 5 cm from the top edge 14 of the fire blanket material 6, but not further than half, at least preferably not further than one third of the height H of the fire blanket material 6, for an advantageous ratio between the height of the screening flap 9 and the front flap 7. In the embodiment shown, this distance to the top edge 14 is approximately 15 cm, so that the front flap too is approximately 15 cm deep. For favourable sizes of the side flaps 8, the distance from the handles 3 to the side edges 13 is preferably at least 5 cm, in the embodiment shown approximately 20 cm. The handles 3 in particular are connected to the fire blanket material 6 at a location such that the hands are well protected from the fire to be extinguished. The handles 3 are also preferably apart from each other so far that they can be put around a pan and/or small fire. In the embodiment shown, the distance between the handles 3 is approximately 64 cm. In a different embodiment, this distance can be selected to be greater or smaller, for instance at least approximately 40 or 50 cm.

Figure 4A:
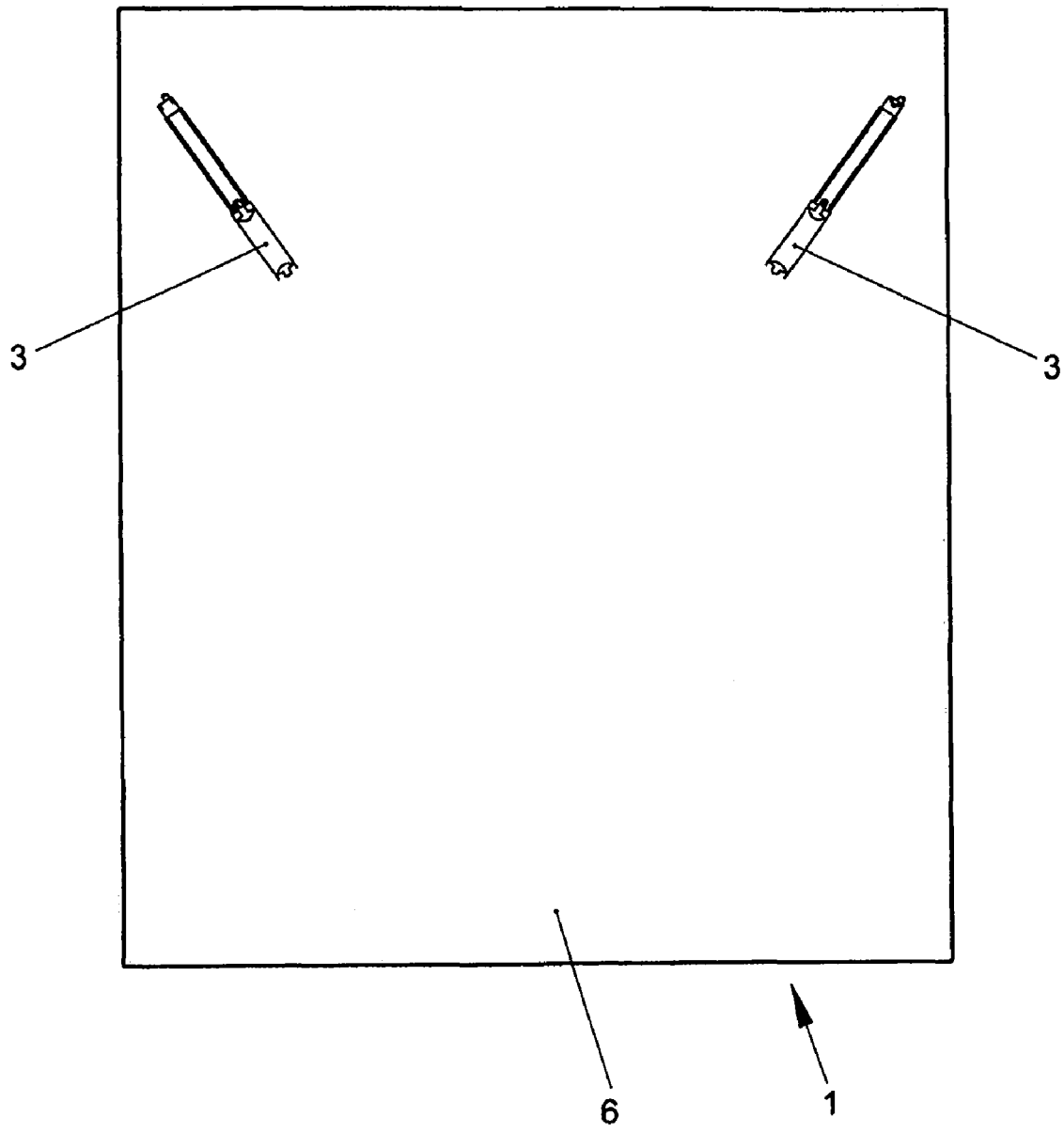

An alternative embodiment of a fire blanket 1 in an extinguishing position, with also the hands being well protected from the fire to be put out, is shown in FIG. 4A. Here, the handles 3 are fastened adjacent the top corners of the blanket material 6 and the ends point inwards. Such a configuration of the handles 3 relative to the blanket material contributes to the hands being protected by the fire blanket 1.

In another embodiment, instead of with the aid of tunnels 15, the handles 3 are fastened to the blanket material 6 in other manners. The handles 3 are for instance glued to the blanket material 6. Advantages of the tunnels 15 are, inter alia, reliability and/or relatively simple separation of the handles 3 from the blanket material 6. This latter may be advantageous for assembling and/or recycling the fire blanket 1.

Figure 5A:
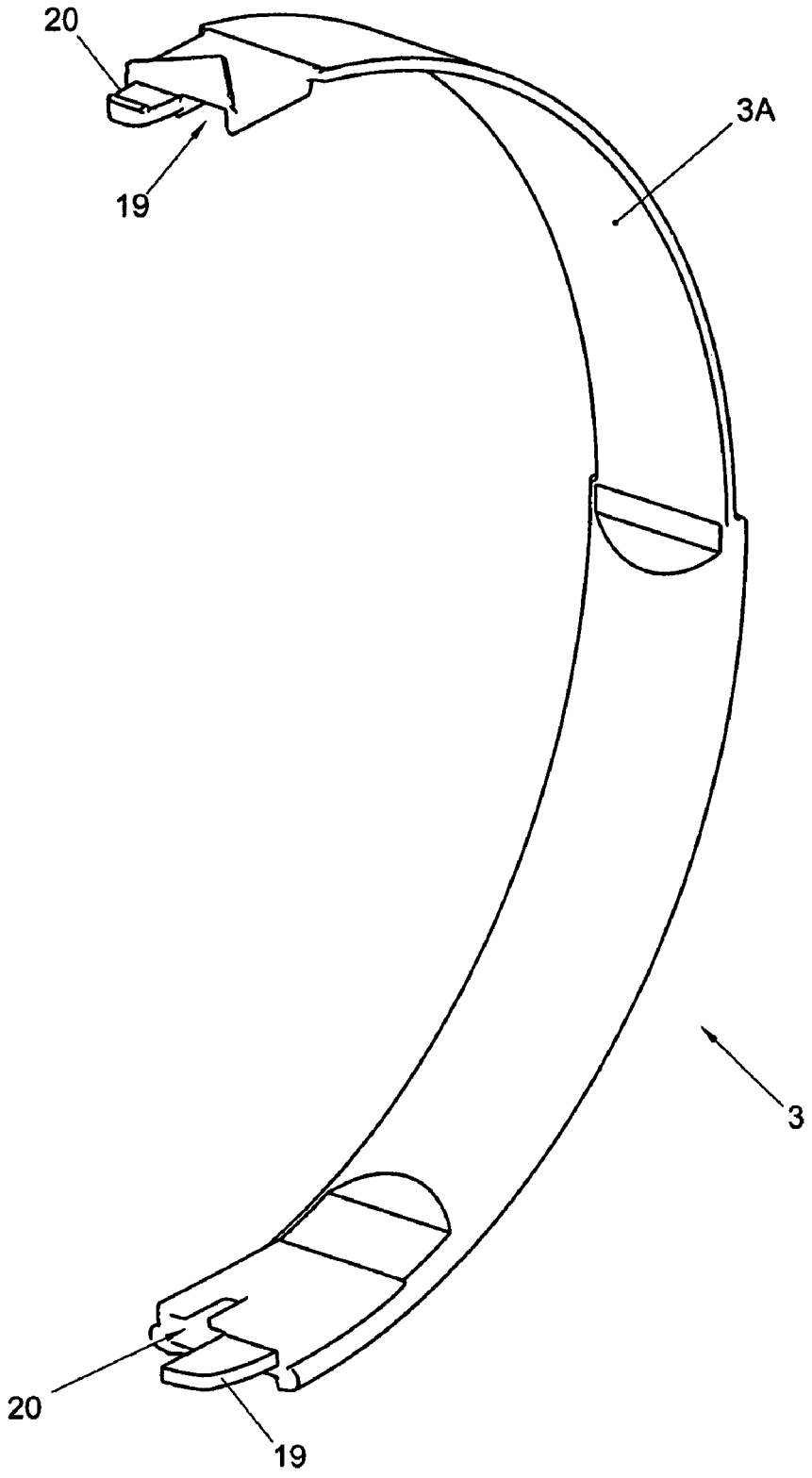
FIGS. 5A, 5B and 5C show handles in different views.

FIG. 5*a* shows a handle 3 in perspective. The handle 3 is provided with connecting elements 17, 18 with which it can be connected with a second, substantially identically shaped handle 3. The connecting elements may comprise male 20 and/or female 19 parts of the handle 3 which fit into corresponding female 19 and/or male 20 parts, respectively, of the second handle 3. In the handle 3 shown, per connecting element 17, 18, both male 20 and female 19 parts are provided. In principle, the handles 3 of one fire blanket 1 can be identical, such as, for instance, the handle 3 of FIG. 5A can be connected with an identical copy thereof.

Figure 5B:
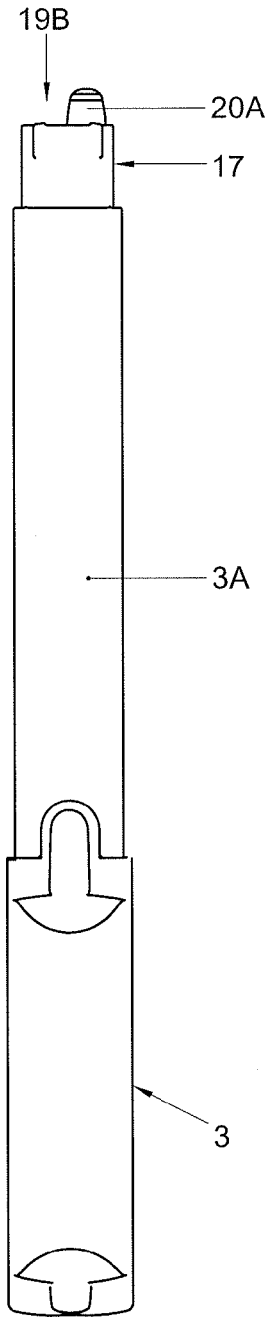
Figure 5C:
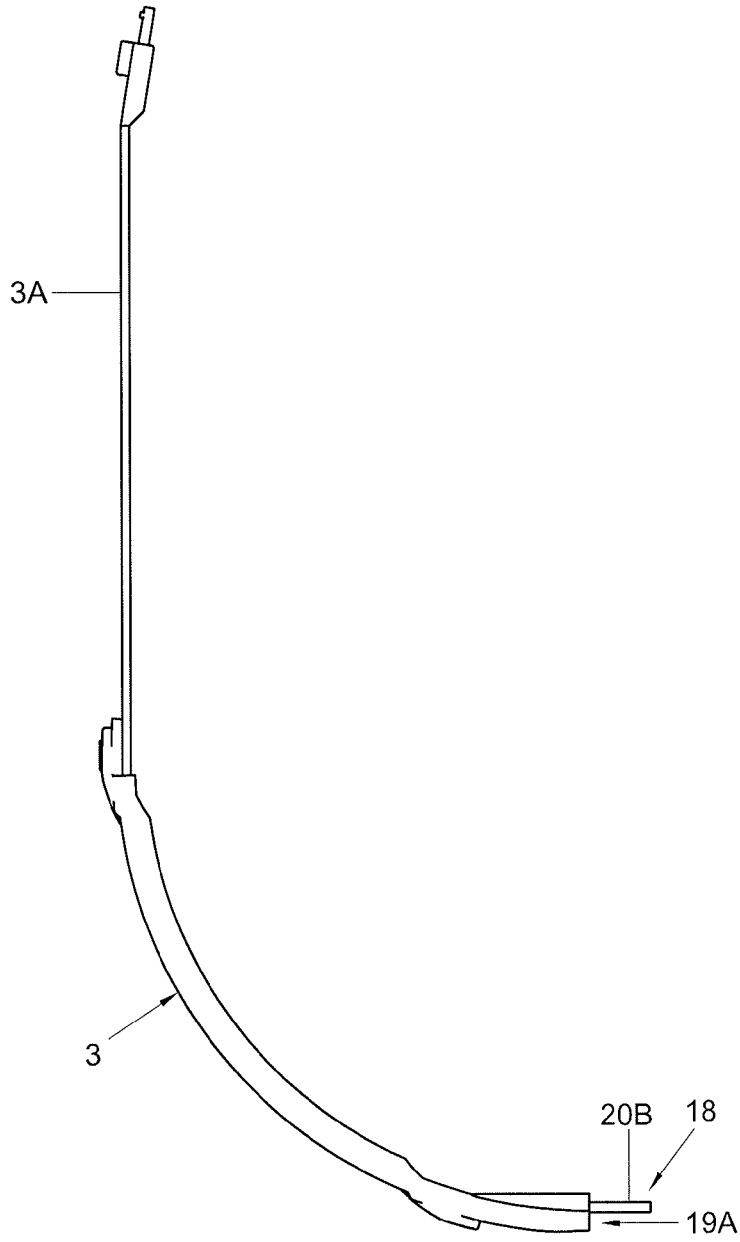

FIGS. 5B and 5C show, from left to right respectively, two handles 3 to be connected with connecting elements 17, 18, a handle 3 in side view, and this handle 3 in front view. A first handle 3 has, for instance, a female part 19A at the bottom side and a male part 20A at the top, to be connected with for instance a male part 20B at the bottom side and a female part 19B at the top side of the second handle 3, respectively. In one embodiment, each of the handles 3 is provided with a resilient distancing element 3A with a connecting element 17. When the connecting elements 17, 18 are interconnected at the top side and bottom side, respectively, the handles 3 together form a closed shape, for instance approximately a circle or ellipse (see for instance FIG. 1A). To this end, the resilient distancing element 3*a* is slightly forced into an arcuate form, as can be seen in FIG. 5A. When the two handles 3 are taken from each other, the distancing element 3A will bounce upwards and slide the package 2 off, upwards from the still largely folded up fire blanket 1 (see FIG. 2C).

Figure 5D:
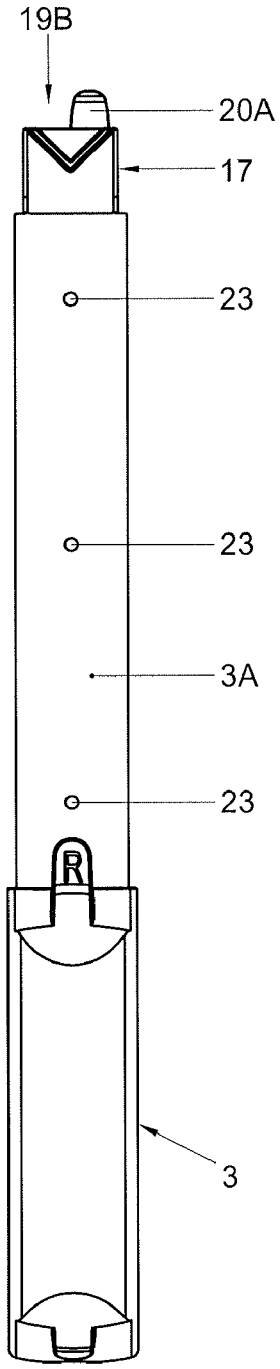
FIGS. 5D and 5E show a handle in side and front view.
Figure 5E:
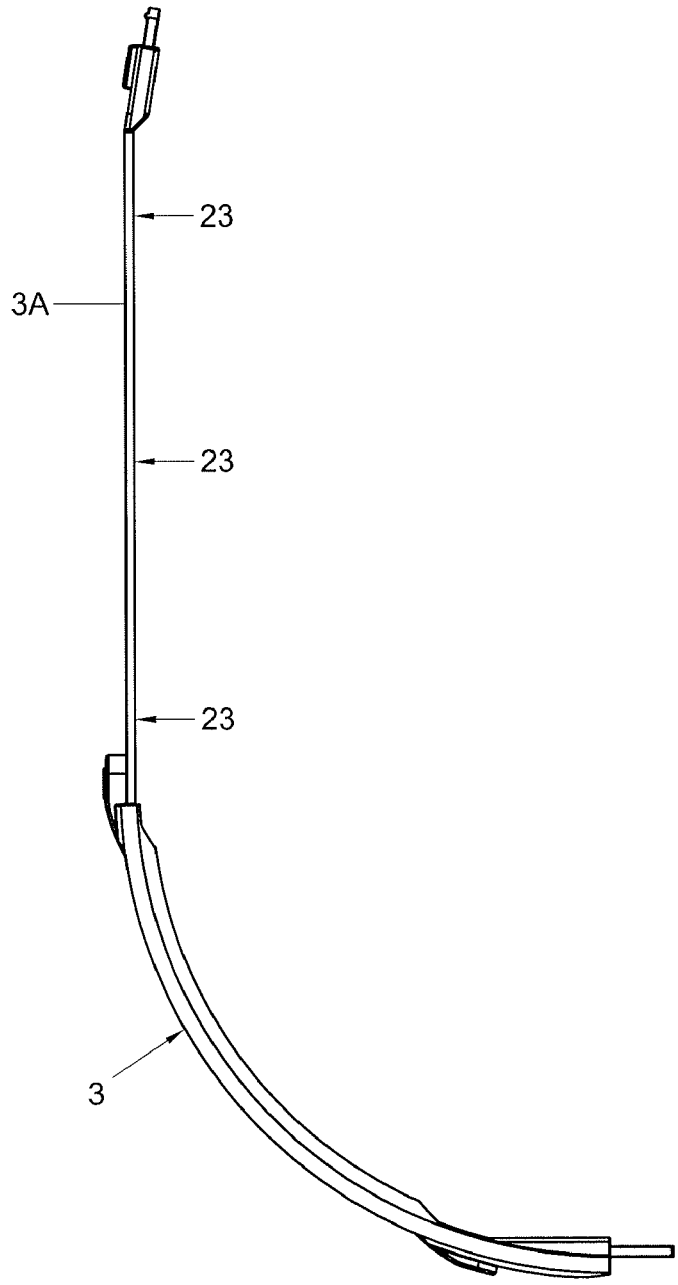
Figure 5F:
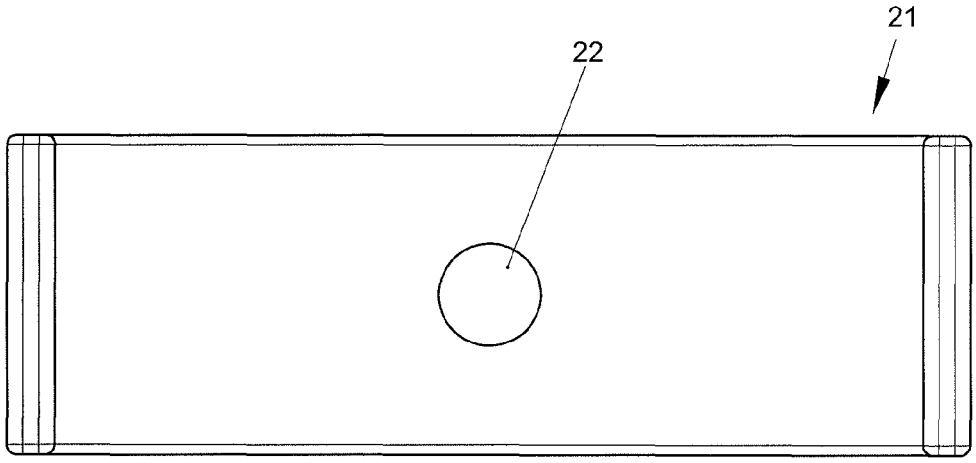
FIGS. 5F and 5G show a bracket in side and front view.
Figure 5G:
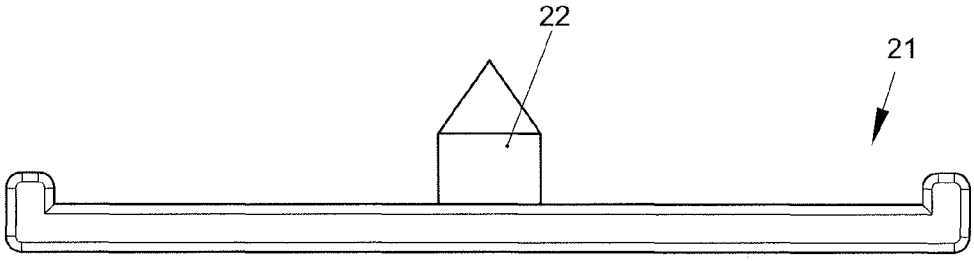

In FIGS. 5D and 5E a further embodiment of a handle 3 is shown wherein the distancing element 3A is shown which cooperates with a bracket 21 for coupling with the blanket material 6. This bracket 21 is shown in FIGS. 5F and 5G. The bracket 21 may be designed for clamping the blanket material 6 between the distancing element 3A and the bracket 21. The bracket 21 or the distancing element may be provided with a projection 22 which corresponds with at least a receiving opening 23 in the distancing element 3A or the bracket, respectively.

Figure 6A:
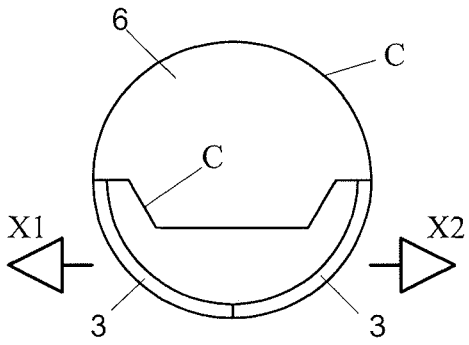
FIGS. 6A-6J show different embodiments of fire blankets without package.
Figure 6B:
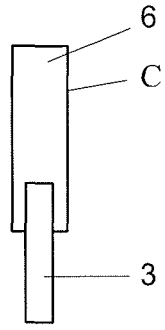
Figure 6C:
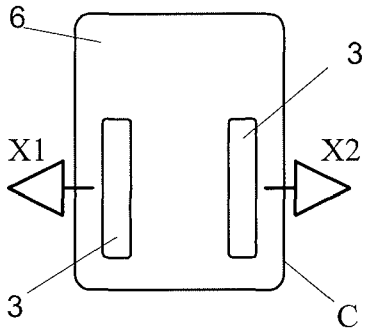
Figure 6D:
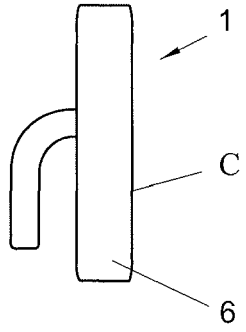
Figure 6E:
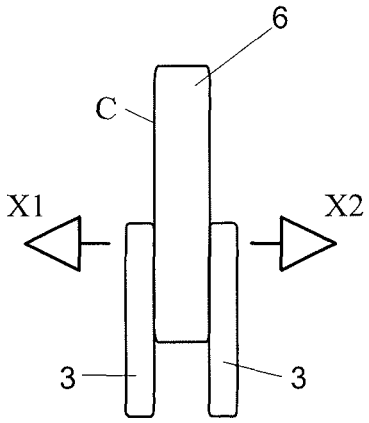
Figure 6F:
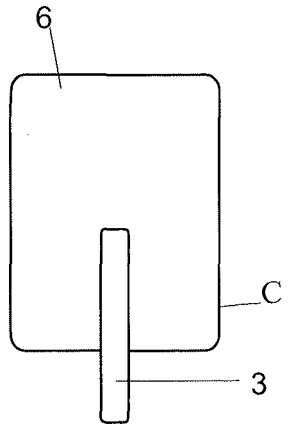
Figure 6G:
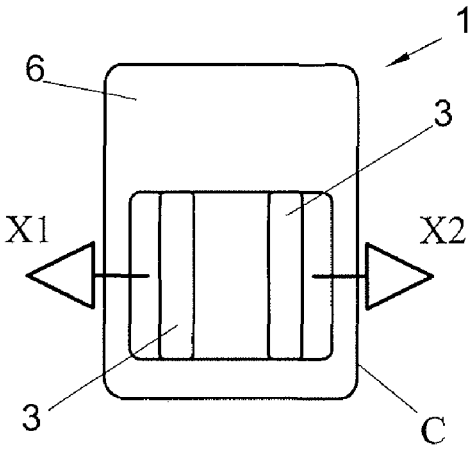
Figure 6H:
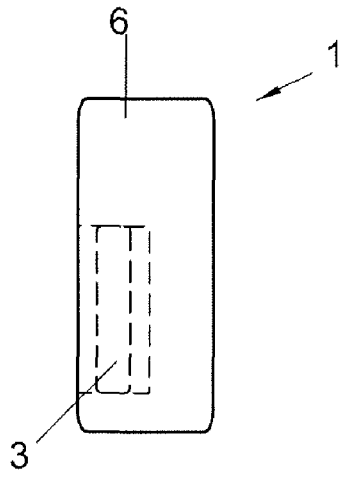
Figure 6I:
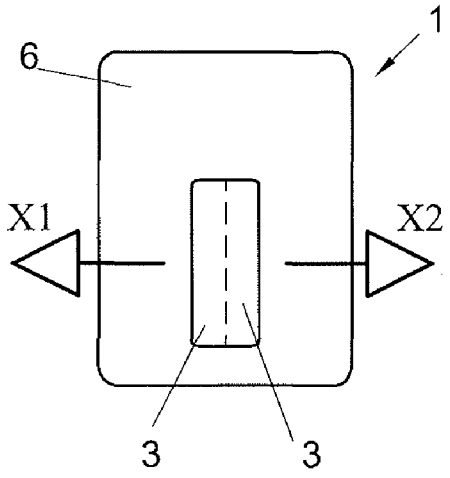
Figure 6J:
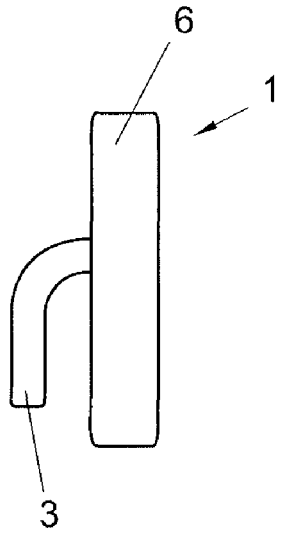

In an alternative embodiment according to the invention, the fire blanket 1 is held, for instance without package 2, in a folded-up storage position, for instance with the aid of a clip or seal or through a certain rigidity of the blanket material 6. The blanket can also be advantageously stored or kept in a storage position without package 2. As can be seen in, for instance, FIGS. 6A-6J, the handles 3 project outside the folded-up blanket material 6 for grasping the handles 3 and preferably also outside a contour C of the blanket material 6 and/or the package 2. Then, the blanket 1 can be pulled open into an extinguishing position by pulling the handles 3 away from each other in a direction X1, X2. The handles 3 project for instance in front view (FIGS. 6A, 6B, 6E and 6F) or side view (FIGS. 6C, 6D, 6I and 6J) outside the contour C of the folded-up blanket material 6. In principle, the embodiments shown in FIGS. 6A-6F can function both with and without package 2. In FIGS. 6G and 6H, an embodiment according to the invention is shown, wherein the blanket material 6 in a storage position is folded such that the handles 3 are engageable with the hands, while the handles 3 do not project outside a contour C in front or side view, but are indeed engageable by the hands to be pulled open into an extinguishing position. In another embodiment, not shown, the handles 3 do not project outside the contour of a package 2, but they can be grasped by one or two hands for pulling the fire blanket 1 open into an extinguishing position. In FIGS. 6I and 6J, an embodiment according to the invention is shown wherein the handles 3 interlock so that initially, they can not be grasped by two hands. Here, the handles 3 are first taken from the package, blanket and all, and only then pulled apart with two hands for pulling the fire blanket 1 open in an extinguishing position.

The described and many comparable variations, and combinations thereof, are understood to fall within the framework of the invention as outlined by the claims. Naturally, different aspects of different embodiments and/or combinations thereof can be combined and replaced with each other. Therefore, delimitation should not be restricted to only the embodiments mentioned.

The invention claimed is:

1. A fire blanket, comprising:

a poorly flammable or inflammable, substantially flexible blanket material; and two relatively rigid handles attached to the blanket material, wherein the blanket material is folded into a storage position, and wherein the two relatively rigid handles project at least partly outside the blanket material folded into the storage position, so that the two relatively rigid handles can be grasped by at least one hand, and wherein the handles are connected to the fire blanket material in a manner such that hands grasping the handles are well protected from a fire, wherein the handles are fastened to the blanket material at a distance from the top edge of the blanket material, the distance from the edge being more than 5 cm and no more than half a height of the blanket material, wherein the blanket material in the storage position is folded up such that when the handles are moved apart, the fire blanket takes up an extinguishing position, wherein the blanket has a relatively small front flap and a relatively large screening flap, wherein the handles comprise distancing elements fastened to the blanket material such that the front flap and the screening flap extend to surround the fire while a blanket part is stretched to a greater or smaller extent and/or approximately horizontally above the fire.

2. The fire blanket according to claim 1, wherein the blanket material is at least partly surrounded by a package, wherein the two relatively rigid handles project at least partly outside the package.

3. The fire blanket according to claim 2, wherein the package is releasably formed such that when the handles are moved apart sufficiently, the package is removed from the fire blanket.

4. The fire blanket according to claim 2, wherein the package is designed to close again after opening.

5. The fire blanket according to claim 2, wherein in a front view of the fire blanket in a storage position the two relatively rigid handles project outside the package.

6. The fire blanket according to claim 1, wherein the two relatively rigid handles have an arcuate shape and/or are partly elastic.

7. The fire blanket according to claim 1, wherein the two relatively rigid handles are provided with connecting elements for connecting the handles to each other.

8. The fire blanket according to claim 1, wherein the two relatively rigid handles have a substantially identical shape.

9. The fire blanket according to claim 2, wherein the package includes a pull-open closing element.

10. The fire blanket according to claim 9, wherein the pull-open closing element is reclosable.

11. The fire blanket according to claim 9, wherein the package is provided with a suspension element.

12. The fire blanket according to claim 11, wherein the closing element is arranged opposite the suspension element.

13. The fire blanket according to claim 2, wherein the package comprises dish parts of poorly flammable material.

14. The fire blanket according to claim 2, wherein the package, in front view, is at least partly red.

15. A method for testing or using a fire blanket, wherein the fire blanket comprises fire blanket material and two relatively rigid handles, the method comprising:

providing the fire blanket material folded into a storage position, wherein the two relatively rigid handles project at least partly outside the blanket material folded into the storage position, wherein the handles are connected to the fire blanket material in a manner such that hands grasping the handles are well protected from a fire, wherein the handles are fastened to the blanket material at a distance from the top edge of the blanket material, the distance from the edge being more than 5 cm and no more than half a height of the blanket material, grasping the handles, and moving the handles sufficiently relative to each other so that the fire blanket is pulled open into an extinguishing position, and wherein, while in the extinguishing position, the blanket has a relatively small front flap and a relatively large screening flap, wherein the handles comprise distancing elements fastened to the blanket material such that the front flap and the screening flap extend to surround the fire while a blanket part is stretched to a greater or smaller extent and/or approximately horizontally above the fire.

16. The method according to claim 15, wherein the blanket material in a storage position is at least partly surrounded by a package, and wherein during the moving the handles step, while the fire blanket is pulled open into an extinguishing position, the package is released from the fire blanket.

17. The fire blanket of claim 1 wherein the handles are connected to the blanket material at least 5 cm from respective side edges of the blanket material.

18. The fire blanket of claim 1 wherein the handles are connected to the blanket material at connection points no more than one-third a height of the blanket material.

19. The method of claim 15 wherein the handles are connected to the blanket material at least 5 cm from respective side edges of the blanket material.

20. The method of claim 15 wherein the handles are connected to the blanket material at connection points no more than one-third a height of the blanket material.

* * * * *